US010018968B2

(12) United States Patent
Willemin et al.

(10) Patent No.: US 10,018,968 B2
(45) Date of Patent: Jul. 10, 2018

(54) SOLAR SKELETON WATCH

(71) Applicant: The Swatch Group Research and Development Ltd, Marin (CH)

(72) Inventors: Michel Willemin, Pretes (CH); Alain Jornod, Neuchatel (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 15/214,634

(22) Filed: Jul. 20, 2016

(65) Prior Publication Data

US 2017/0168460 A1 Jun. 15, 2017

(30) Foreign Application Priority Data

Dec. 15, 2015 (EP) ..... 15200201

(51) Int. Cl.

| | |
|---|---|
| ***G04C 10/02*** | (2006.01) |
| ***G04C 3/14*** | (2006.01) |
| ***G04B 45/02*** | (2006.01) |

(52) U.S. Cl.

CPC ..... *G04C 10/02* (2013.01); *G04B 45/02* (2013.01); *G04C 3/14* (2013.01)

(58) Field of Classification Search

CPC ..... G04B 19/12; G04B 37/00; G04B 45/00; G04B 45/02; G04C 10/02; G04G 17/04; G04G 19/00

See application file for complete search history.

(56) References Cited

U.S. PATENT DOCUMENTS

| | | | | |
|---|---|---|---|---|
| 4,261,049 | A * | 4/1981 | Komiyama | G04C 10/02 368/205 |
| 4,534,660 | A * | 8/1985 | Laesser | G04B 29/02 368/220 |
| 4,791,621 | A | 12/1988 | Wild et al. | |
| 4,926,401 | A * | 5/1990 | Vuilleumier | G04B 37/225 368/223 |
| 5,703,837 | A * | 12/1997 | Umemoto | G04B 19/12 368/227 |
| 6,518,493 | B1 * | 2/2003 | Murakami | H01L 31/02167 136/244 |
| 6,901,033 | B2 | 5/2005 | Ito | |
| 9,354,614 | B2 * | 5/2016 | Dubois | G04G 17/045 |

(Continued)

FOREIGN PATENT DOCUMENTS

| | | |
|---|---|---|
| CN | 204389897 U | 6/2015 |
| FR | 2 595 481 | 9/1987 |

(Continued)

OTHER PUBLICATIONS

JP2000-221278 English translation. Retrieved from the Internet Aug. 12, 2017.*

(Continued)

*Primary Examiner* — Vit M Miska
(74) *Attorney, Agent, or Firm* — Oblon, McClelland, Maier & Neustadt, L.L.P.

(57) ABSTRACT

A skeleton watch including a case provided with a back cover and a crystal, and a set of components forming a movement of the skeleton watch, the components being arranged inside the case between the back cover and the crystal and being wholly or partially visible through the crystal, wherein the skeleton watch comprises at least one solar cell.

13 Claims, 3 Drawing Sheets

(56) References Cited

U.S. PATENT DOCUMENTS

| | | | | |
|---|---|---|---|---|
| 2008/0002527 | A1* | 1/2008 | Ishii | G04G 9/0035 368/239 |
| 2010/0097896 | A1* | 4/2010 | Baba | G01S 19/14 368/47 |

FOREIGN PATENT DOCUMENTS

| | | | |
|---|---|---|---|
| JP | 9-5450 | | 1/1997 |
| JP | 9-281254 | | 10/1997 |
| JP | 10-177077 | * | 6/1998 |
| JP | 10-288676 | * | 10/1998 |
| JP | 2000-221278 | * | 8/2000 |
| JP | 2001-311785 | * | 11/2001 |
| JP | 2006-47234 | * | 2/2006 |
| JP | 2011-203213 | | 10/2011 |

OTHER PUBLICATIONS

JP2006-47234 English translation. Retrieved from the Internet Aug. 15, 2017.*

European Search Report dated May 2, 2016 in European Application 15200201, filed on Dec. 15, 2015 ( with English Translation of Categories of Cited Documents and Written Opinion).

* cited by examiner

SOLAR SKELETON WATCH

This application claims priority from European Patent Application No. 15200201.0 filed Dec. 15, 2015, the entire disclosure of which is hereby incorporated herein by reference.

SUBJECT OF THE INVENTION

The present invention relates to the technical field of horology. It relates more particularly to a watch of the skeleton type comprising a solar cell. A "skeleton watch" means a watch comprising a movement in which some parts, typically the dial, main plate and/or bridges are pierced so that the elements of the movement are visible to the person wearing the watch.

BACKGROUND OF THE INVENTION AND PRIOR ART

It is common practice to provide watches with a solar cell in order to power the electronic movement. The solar cell is generally disposed on the periphery of the dial beneath the crystal, or may replace the dial to absorb maximum light. There are also alternatives, such as in U.S. Pat. No. 8,693,290 and EP Patent 2796946, wherein the solar cell is positioned under the dial which is made of a transparent or translucent resin.

In such configurations, the watch movement is obscured by the dial or by the solar cell, which is incompatible with so-called skeleton watches, since the latter do not generally include a solid dial and expose all or part of their constituent components. Indeed, in such case, keeping the elements visible is incompatible with a solar cell arrangement, since the cell must also be visible to absorb light and generate sufficient energy to power a quartz movement.

SUMMARY OF THE INVENTION

It is an object of the present invention to incorporate a photovoltaic cell in a watch of the skeleton type, while maintaining an exposed surface area that is sufficient to power a quartz watch movement or an additional electronic function in the case of a mechanical watch movement.

To this end, there is proposed a skeleton watch according to claim 1 appended hereto and particular embodiments are covered in the dependent claims.

BRIEF DESCRIPTION OF THE DRAWINGS

The features and advantages of the present invention will appear upon reading the detailed description hereinafter, with reference to the following Figures.

DETAILED DESCRIPTION OF THE INVENTION

The present invention relates to a watch of the skeleton type provided with at least one photovoltaic cell, which will also be referred to as a "solar cell" or simply a "cell" in the context of this document.

Figure 2:
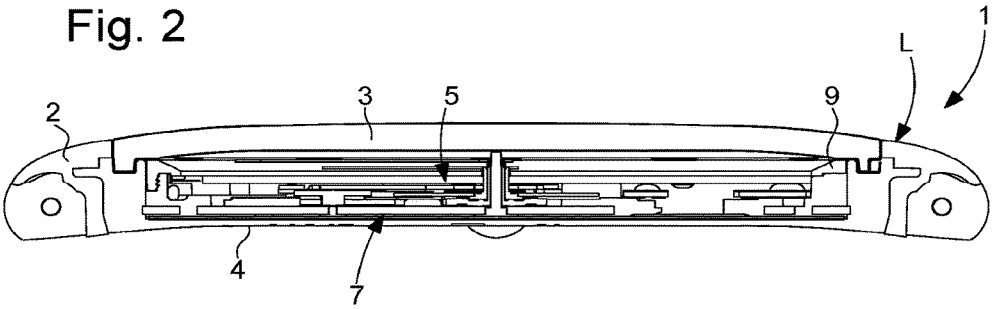
Figure 3:
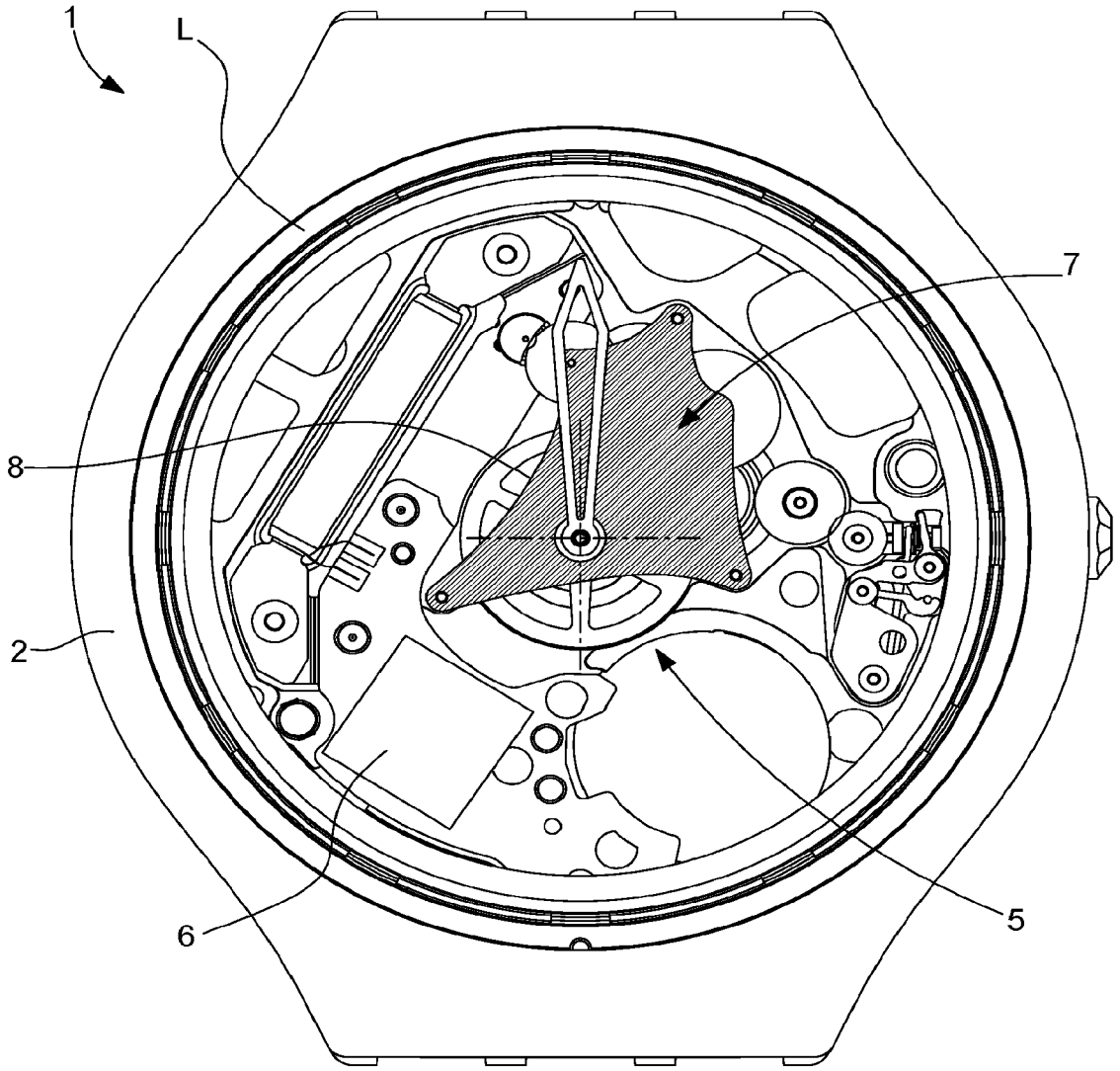
FIGS. 3 and 4 respectively represent a top view and an exploded view of the skeleton watch provided with a solar cell according to another preferred embodiment of the invention. According to this second embodiment, the cell is placed on elements visible through the crystal and, more specifically, on a bridge in FIG. 3 and on an integrated circuit in FIG. 4.
Figure 4:
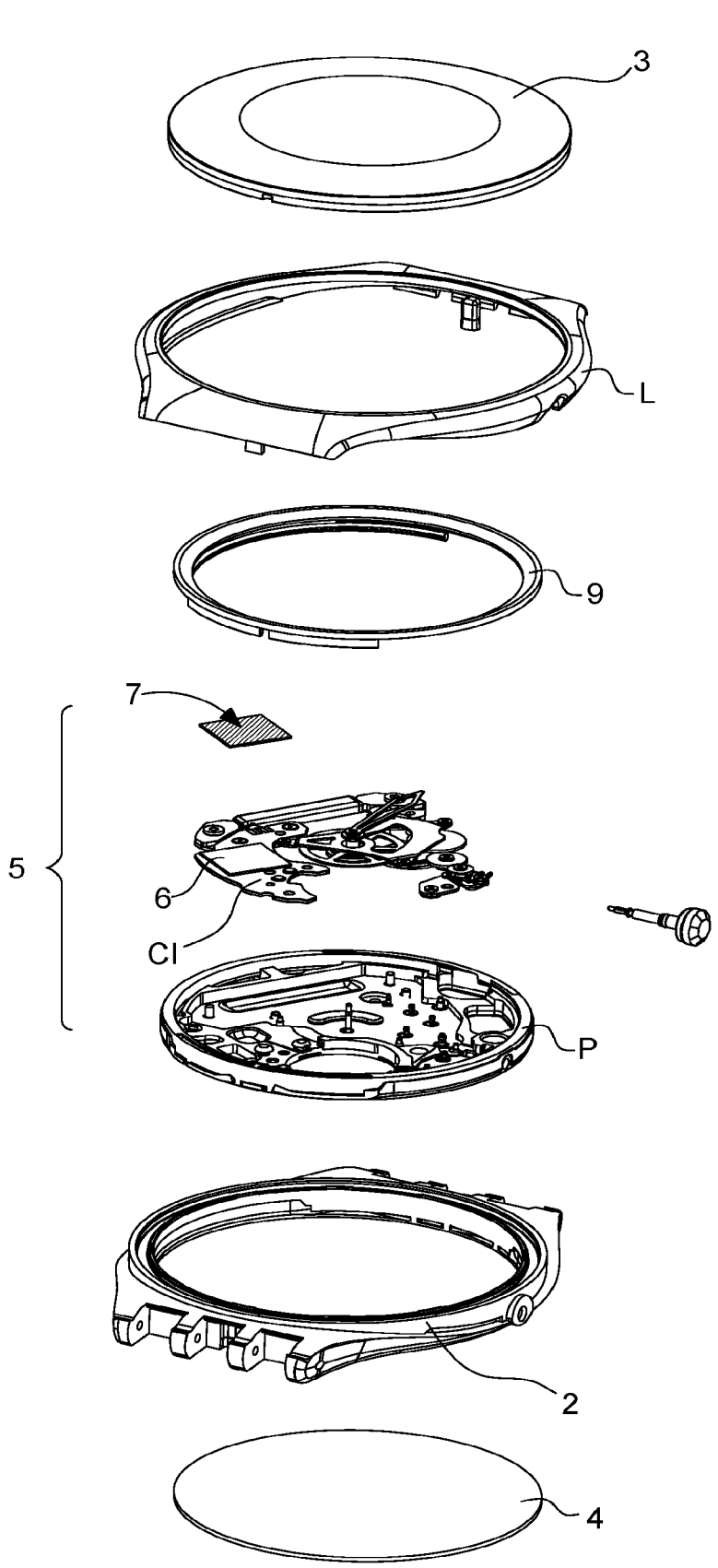

FIGS. 1 to 4 represent a skeleton watch 1 which, in a conventional manner, comprises a case formed of the case middle 2, the crystal 3 and back cover 4. The crystal is secured on case middle 2 in a conventional manner with the aid of a bezel L. In the illustrated example, the case houses all the elements of a conventional quartz movement 5 (FIG. 4). The Figures illustrate, in particular, a main plate P comprising several cutout portions $A_1$, $A_2$, $A_3$, $A_4$, $A_5$, $A_6$, $A_7$ and $A_8$, an electric motor M, a gear train R and an integrated circuit 6. The elements are disposed between case back 4 and crystal 3 and are wholly or partly visible through the crystal. In this example, movement 5 is maintained inside case middle 2 with the aid of a flange 9 also forming the casing ring. According to a variant that is not represented, movement 5 may be a mechanical watch movement.

The originality of the skeleton watch lies in the addition of a solar cell and in the positioning thereof inside the case.

Figure 1:
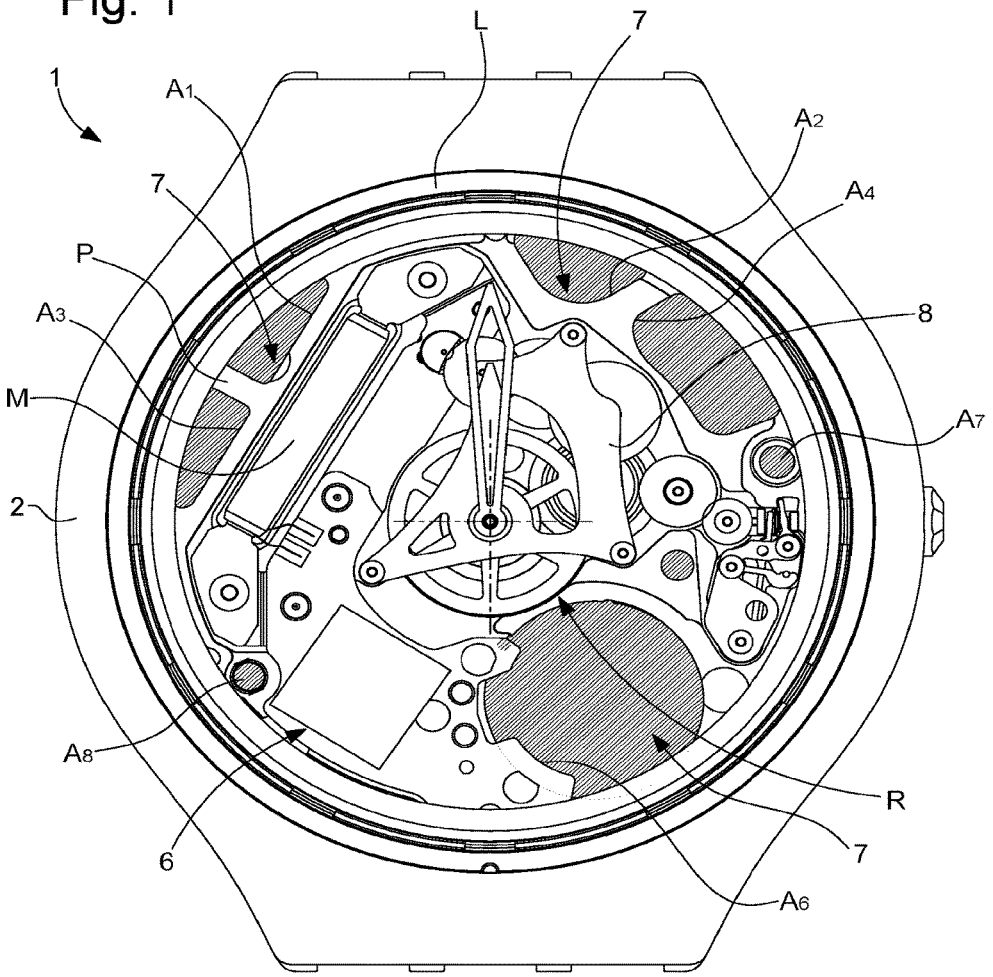
FIGS. 1 and 2 respectively represent a top view and a cross-sectional view of the skeleton watch provided with a solar cell according to a preferred embodiment of the invention. According to this first embodiment, the cell is placed between the case back and the elements of the movement.

According to a first embodiment illustrated in FIGS. 1 and 2, photovoltaic cell 7 is disposed on the watch case back 4 between the latter and movement 5. Light passes through crystal 3 and reaches cell 7 through cutout portions $A_1$, $A_2$, $A_3$, $A_4$, $A_5$, $A_6$, $A_7$ and $A_8$, formed between the movement components and in particular in plate P. These movement components obscure a surface area comprised between 65 and 90% of the surface area of case back 4. This means that cutouts $A_1$, $A_2$, $A_3$, $A_4$, $A_5$, $A_6$, $A_7$ and $A_8$ represent between 10 and 35% of this surface area. By way of example, for a watch having a case middle with a circular cavity of 2.9 cm in diameter, namely a case back surface area of around 660 $mm^2$, the surface area of the cutouts is around 146 $mm^2$, namely 22% of the case back surface area. With such an illuminated effective surface area, the power captured by the cell is equivalent to that captured by a cell of 2.9 cm in diameter placed under a dial with a transmission of 22%. The power thereby harvested, for example, by an amorphous silicon solar cell made by physical and chemical deposition (PVD, CVD) on stiff or flexible substrates, is an average of 4.4 μW over a year. This power is significantly higher than the consumption of a quartz movement with 2 hands, which is typically 0.3 μW. It is to be noted that, if required, it is possible to increase the illuminated effective surface area by making some of the movement components, such as the bars, bridges and gear trains, in transparent or translucent material. It is thus possible to increase the illuminated effective surface area to 35% corresponding to an average annual captured power of 7 μW. Other solar cell technologies may be used, such as, for example, cells using: crystalline silicon, heterojunction silicon, CuInGaSe, CuInSe, CdTe, AsGa, or organic materials. AsGa technology, for example, could provide an average annual power of 16.8 μW for the same 146 $mm^2$ of exposed surface area. Further, it will be noted that the solar cells may be coated with additional layers, for example with a decorative layer of semi-transparent material, to impart a particular aesthetic compatible with the movement components, such as, for example, a gold appearance. The transmission loss resulting from the addition of such layers could be offset by a more efficient solar cell technology, typically by using CuInGaSe-based or AsGa-based solar cells.

Preferably, a single solar cell is disposed on case back 4 and covers the entire case back or a particularly well illuminated portion thereof. It is, however, also possible to envisage placing several individual cells connected to each other on case back 4 with each of the cells arranged facing a cutout. In the case where the cells are connected in series to obtain a higher output voltage, it is preferable for the surface area of each of the cells to be similar to avoid a current limitation imposed by the cell having the smallest exposed surface area. Connecting the cells in parallel avoids current limitation due to surface area but the output voltage is lower. Electrical connection of the wires is achieved, for example, by soldering with a suitable alloy (tin or other), by heat compression, possibly ultrasonic-assisted.

According to a second embodiment illustrated in FIGS. 3 and 4, a photovoltaic cell 7 is placed on an element exposed to view, between the latter and crystal 3. In this manner, light passes through the crystal and directly reaches photovoltaic cell 7. The cell is preferably placed on a fixed component of the movement to keep at least partially visible the moving components which are the attraction of the skeleton watch. For example, cell 7 may be placed on a bridge 8, as shown in FIG. 3. It may also be placed on integrated circuit 6 of the quartz movement, as shown in FIG. 4, or of the electronic function to be powered, in the case of an unrepresented variant of a mechanical movement fitted with a complementary electronic module. In a variant, cell 7 may alternatively or additionally be placed on the printed circuit Cl carrying integrated circuit 6. A cell may straddle several elements or several cells may be disposed on the elements provided that each cell has a similar exposed surface area, again to avoid the current limitation imposed by the smallest cell. In this embodiment, the aim is an illuminated effective surface area comprised between 8 and 27% of the total surface area visible through the crystal, i.e. an average annual harvested power comprised between 1.6 and 5.4 μW for amorphous silicon and between 6.1 and 20.6 μW for AsGa.

The present invention does not excludes combining the two embodiments, i.e. positioning cells on the case back and on the components visible through the crystal.

The assembly of the cell to the case can be achieved very simply with no need to create a structure to carry the cell. For example, cell 7 may be adhesive bonded or snap fitted on to case back 4 or onto a component, depending on the selected embodiment. It is not necessary to provide a specific housing which would modify the stamping operations during the manufacture of the case. If necessary, movement 5 could simply be raised by the thickness of the cell if the cell is positioned on the case back. This type of assembly also better protects the cell which, depending on the photovoltaic technology selected, may be intrinsically fragile such as, for example, in the case of a glass substrate.

To store the electrical energy produced, the integrated circuit is preferably associated with a storage capacitor or a rechargeable battery (not shown). The electrical connection between the cell(s) and the printed circuit may be achieved by two wires or by contact springs disposed under the printed circuit board Cl carrying the integrated circuit and the capacitor.

The electrical energy produced is used to power the quartz movement or an additional function in a mechanical watch, for example, a lighting function.

What is claimed is:

1. A skeleton watch comprising a case provided with a back cover and a crystal, and a set of components forming a movement of the skeleton watch, said components being arranged inside the case between the back cover and the crystal and being wholly or partially visible through the crystal, wherein the skeleton watch comprises at least one solar cell, wherein one or more solar cells are disposed between the case back and the set of components, each cell being exposed to light through cutout portions formed between and/or in the components forming said movement, and wherein it comprises a solar cell covering the entire surface of the case back;

wherein one or more of the components is made in a transparent or translucent material; and wherein the solar cell or cells are disposed on at least one component visible through the crystal.

2. The skeleton watch according to claim 1, wherein one of the components carrying a solar cell is a fixed structure of the movement.

3. The skeleton watch according to claim 1, wherein the component is a bridge or an integrated circuit or a printed circuit.

4. The skeleton watch according to claim 1, wherein, in the case of a plurality of solar cells, each solar cell has the same surface area exposed to light through the crystal.

5. The skeleton watch according to claim 1, wherein the light-exposed surface area of the solar cell or cells is comprised between 10 and 35% of the total surface area exposed to light through the crystal.

6. The skeleton watch according to claim 1, wherein the solar cell or cells are made of amorphous silicon.

7. The skeleton watch according to claim 1, wherein each solar cell is assembled by adhesive bonding inside the case.

8. The skeleton watch according to claim 1, comprising a quartz movement or a mechanical movement.

9. The skeleton watch according to claim 1, wherein said solar cells are connected in series.

10. The skeleton watch according to claim 9, wherein said solar cells each have a substantially identical surface area.

11. The skeleton watch according to claim 1, wherein said solar cells are connected in parallel.

12. The skeleton watch according to claim 1, wherein the solar cells are coated with a semi-transparent decorative layer.

13. The skeleton watch according to claim 12, wherein said solar cells are AsGa-based or CuInGaSe-based solar cells.

* * * * *